United States Patent [19]

Maitland et al.

[11] Patent Number: 4,896,073

[45] Date of Patent: Jan. 23, 1990

[54] DISCHARGE TUBES

[75] Inventors: Arthur Maitland, St. Andrews, Scotland; Hugh Menown, Writtle, United Kingdom

[73] Assignee: English Electric Valve Company Limited, Chelmsford, United Kingdom

[21] Appl. No.: 87,922

[22] Filed: Aug. 21, 1987

[30] Foreign Application Priority Data

Aug. 30, 1986 [GB] United Kingdom ..... 8621023

[51] Int. Cl.[4] ..... H01J 17/16

[52] U.S. Cl. ..... 313/634; 313/631; 313/157

[58] Field of Search ..... 313/157, 592, 595, 597, 313/604, 621, 631, 634; 315/94

[56] References Cited

U.S. PATENT DOCUMENTS 2,013,093 9/1935 Frantz ..... 313/157

3,524,097 8/1970 Mancebo ..... 313/592

*Primary Examiner*—Robert L. Griffin

*Assistant Examiner*—T. Salindong

*Attorney, Agent, or Firm*—Spencer & Frank

[57] ABSTRACT

A discharge tube arrangement, for example, a thyratron, in accordance with the invention has a first electrode arranged co-axially about a second electrode. Thus, in a thyratron, the anode may surround the cathode or vice versa. The envelope may be tubular having an aperture at its center. The discharge tube arrangement is constructed such that it is capable of being added to another such arrangement. A plurality of such arrangements may be added together to produce, for example, a thyratron capable of large current conduction.

8 Claims, 4 Drawing Sheets

DISCHARGE TUBES

FIELD OF THE INVENTION

This invention relates to gaseous discharge tubes and more particularly, but not exclusively, to thyratrons.

BACKGROUND OF THE INVENTION

A conventional thyratron, in its simplest form as schematically illustrated in FIG. 1, comprises a flat anode plate 1 facing a cathode 2 with a control grid 3 located between them, this electrode arrangement being contained within a gas filled envelope 4. When it is wished to trigger the thyratron into conduction, a positive potential may be applied to the control grid 3, which previously was held at a negative bias potential, and a discharge is developed between the anode 1 and cathode 2. The amount of current which the thyratron is capable of conducting satisfactorily is determined to some extent by the area of the anode and cathode facing surfaces. With conventional geometry, change of area is obtained by change of diameter and thus, if a larger current capability is required, the thyratron must be designed to have greater anode and cathode diameters.

SUMMARY OF THE INVENTION

According to this invention a discharge tube comprises an arrangement of an envelope and a first electrode arranged co-axially about a second electrode, the arrangement being constructed such that it is capable of being added to another such arrangement to alter the dimensions of the discharge tube. Thus by adding one or more additional arrangements to a first, the current conducting capability of the discharge tube may be increased, since the surface area of the electrodes may also be increased. By providing the capability of adding an additional arrangement to a first, manufacture of the discharge tube may also be facilitated. Only a single size arrangement need be made initially and then a number of them may be added together to produce a desired size of discharge tube. Alternatively, a set of such arrangements might be provided to a user who may then choose the number he adds together to suit his own requirements.

It can be shown that the surface area of a co-axial arrangement is greater than that of a discharge tube with conventional planar geometry of similar electrode radius when the length of the co-axial electrodes is approximately two or more times greater than the radius. Thus, the co-axial symmetry is such that, for practical lengths and radii, it is not difficult to obtain electrode surface areas of more than twice that possible for tubes of conventional planar geometry and similar radius. If the radius of an electrode arrangement of a conventional planar device is arranged to be large, and thus accommodate high current conduction capability, the increased radius makes it more difficult to remove the heat generated because of the longer heat conduction paths extending radially from the centre of the discharge tube. Also, since in the conventional discharge tube, heat can only be removed from the outer cylindrical surface which surrounds the volume, the surface to volume ratio of the tube should be as large as is practicable. For unit length of a cylinder, the surface to volume ratio is inversely proportional to the radius of the cylinder. These considerations indicate that a device with a small radius may be more easily cooled than one with a larger radius. Thus, since a discharge tube in accordance with the invention may practicably have relatively large electrode and envelope surface areas compared to a conventional device, cooling is improved and greater current may be conducted through the tube.

Preferably, the envelope has a transverse-section which is topologically equivalent to an annulus. By "topologically equivalent to an annulus" it is meant that the transverse-section is defined by two closed, non-intersecting boundaries. For the purposes of discussion, a discharge tube with an annular transverse-section is now considered and is herein referred to as an annular tube. The central aperture defined by the inner walls of the annulus is a particularly advantageous feature since it provides a convenient location for magnetic, electrical or mechanical components for example, giving a compact arrangement of low inductance. Cooling media may be passed through the aperture, enabling heat to be transmitted from a greater surface area than that available to a conventional arrangement.

Advantageously, an electrical lead is connected to the outer surface of the first electrode and is extensive in a plane, and preferably the lead is an annulus. Where the discharge tube is used as a switch, such as a thyratron, the invention is particularly useful, since it enables connections of low inductance to be made. A thyratron in accordance with the invention may be designed to conduct large currents by increasing the electrode diameters, increasing the length of the electrodes or a combination of the two, whichever is most convenient, thus enabling a flexible approach to the design to be used.

In one embodiment of the invention, the second electrode is arranged to act as an anode. This electrode may comprise at least part of the envelope, defining, for example, the inner surface of the envelope but the other electrode may alternatively or also form part of the envelope. It is advantageous in such an embodiment that, where the envelope is an annular tube, a coolant, such as oil, is arranged to flow outside the envelope in the volume defined by its inner wall.

In an alternative embodiment the second electrode is arranged to act as a cathode. The second electrode may form the cathode entirely, or it may be arranged to enclose, at least partially, a volume in which a discharge is arranged to occur, such that an enclosed volume of ionised gas and the second electrode together act as the cathode. Where the cathode is thermionic, and the envelope is an annular tube, a heater or heaters can be located in the central region.

In embodiments where the first electrode is arranged to act as an anode, it may be associated with a screen grid at cathode potential. The screen grid may be arranged to lie co-axially outside or inside the first electrode.

Advantageously, high frequency electromagnetic radiation may be arranged to produce a discharge within the tube. This may be arranged so as to trigger a thyratron into conduction, and/or may be arranged to produce a plasma in a volume at least partially enclosed by a surface at cathode potential to form a cathode structure which includes both the electrode and the plasma within the volume.

In some arrangements, a grid or grids may be located between the first and second electrodes to enable greater control to be exercised over the operation of the tube. A cylindrical grid electrode may have a very large aperture area compared with a conventional discshaped grid, and because of its geometry have good heat conduction properties.

When a gas switch of the thyratron type is triggered into conduction, it is said to operate as a closing switch. A switch which may be triggered to change from a conducting to an insulating state is an opening switch. Both types of switch rely on field penetration through grid apertures for their successful operation on given trigger signals, because an opening switch must initially be closed. Field penetration through the grid apertures must be possible in both types of switch to enable them to be closed on a given trigger. To ensure the possibility of field penetration through an aperture in a metallic grid, the ratio of aperture dimension to grid thickness must be less than that which will allow direct breakdown of the anode/cathode gap and greater than that which will prevent sufficient field penetration for triggering to be possible. Thus, the smaller the aperture, the thinner the grid must be. The grid apertures of an opening switch must be of dimensions such that, when an appropriate potential is applied, the resulting plasma sheath extends across the entire aperture area. It can be shown that, as the current density increases, the thickness of the plasma sheath decreases, and thus a maximum practicable current density exists beyond which it is not feasible to employ grids with smaller apertures because of difficulties of fabricating thin grids with very small apertures. Further difficulties arise in the reduced thermal capacity and poor thermal conduction from the grid centre to its periphery. Where the grid is a disc, and the grid apertures are a mesh, say, as in a conventional opening switch, the discharge current tends to have larger current densities at the centre of the grid than at its circumference. Thus, the apertures at the periphery of the mesh are not used effectively. Because of the cylindrical geometry of a grid in accordance with the invention, a plurality of apertures may be included in the grid at the same radial distance from the axis of the cylinder, and thus radially dependent jitter is substantially reduced. Since the surface area of such a cylindrical grid may be large, the apertures may be made small enough to permit grid control to switch off the device when desired, whilst still enabling an appreciable current to be conducted.

In one embodiment of the invention, magnetic means may be included to improve uniformity of the discharge during conduction, a device in accordance with the invention particularly lending itself to such an arrangement because of its geometry.

According to a feature of this invention, a thyratron arrangement includes a discharge tube in accordance with the invention.

BRIEF DESCRIPTION OF DRAWINGS

Some ways in which the invention may be performed are now described by way of example with reference to the accompanying drawings in which.

DESCRIPTION OF PREFERRED EMBODIMENTS

Figure 1:
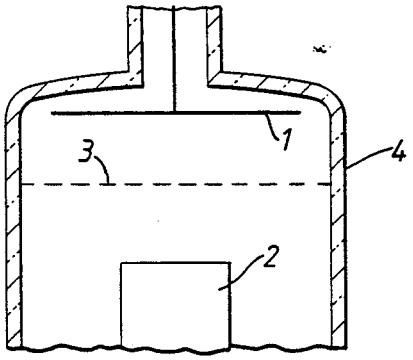
FIG. 1 illustrates a conventional thyratron.
Figure 2:
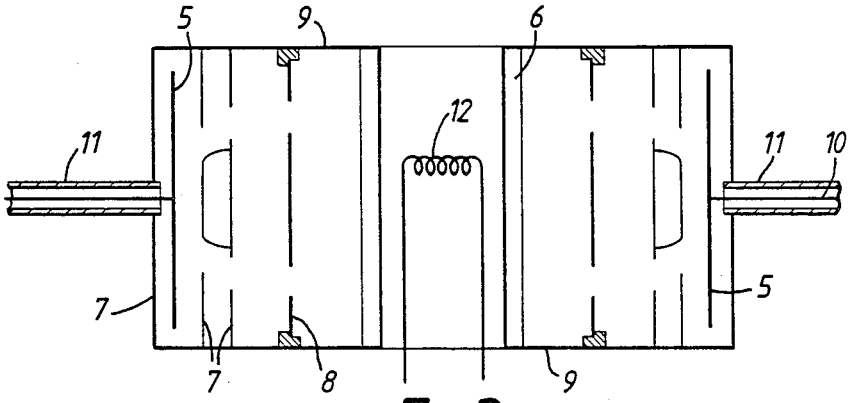
FIGS. 2, 3, 4, 6, 7, 8 and 9 schematically illustrate thyratrons in accordance with the invention.

With reference to FIG. 2, a cylindrical, gas-filled thyratron includes a first, cylindrical anode electrode 5, which co-axially surrounds a second cylindrical cathode electrode 6. The anode 5 is partially surrounded by a screen grid 7 at cathode potential. A control grid 8 is located between the screen grid 7 and the cathode 6. The envelope of the thyratron is of annular transverse section and is formed partially by the portion of the screen grid 7 located outside the anode 5, the cathode 6 and end pieces 9 which are electrically connected to the cathode 6. The anode lead 10 is in the form of an annulus extending from, and substantially normal to, the outer surface of the anode 5 and through the screen grid 7. Insulating annuli 11 are located on each side of the annulus 10. A cathode heater 12 is located within the central aperture of the tubular envelope. During operation, a negative bias is initially applied to the control grid 8. When it is wished to achieve conduction between the cathode 6 and anode 5, a positive pulse is applied to the control grid 8 and a discharge is formed in the control grid-cathode space, and the thyratron conducts. Since the surfaces of the anode 5 and cathode 6 are relatively large, a large discharge current may be passed at current densities which are characteristics of the glow mode of discharge. The arrangement is such that, if desired, the end pieces 9 may be removed to enable connection to be made to another similar arrangement, enabling the current conduction capability of the device to be increased.

Figure 3:
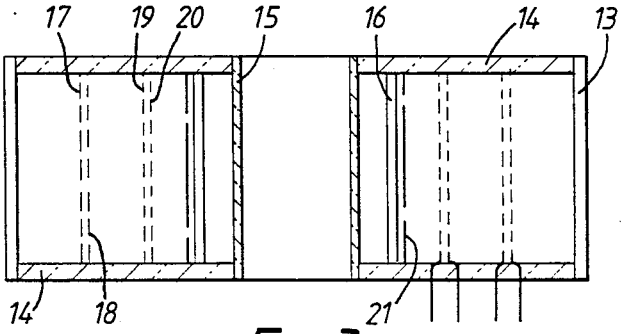

With reference to FIG. 3, another thyratron in accordance with the invention includes an envelope which is an annular tube and which comprises a cathode 13, ceramic end pieces 14 and an inner ceramic tube 15. A cylindrical anode 16 is located within the envelope adjacent to the inner ceramic tube 15. Cylindrical control grids 17, 18, 19 and 20 are located between the cathode 13 and anode 16, and a screen grid 21 is included adjacent the anode 16. In this embodiment the central aperture through the envelope may be occupied by other elements included in the circuit in which the thyratron is connected. The thyratron shown in FIG. 3 operates in a multi-gap mode, and again it may be joined to another such arrangement to increase correct conduction.

Figure 4:
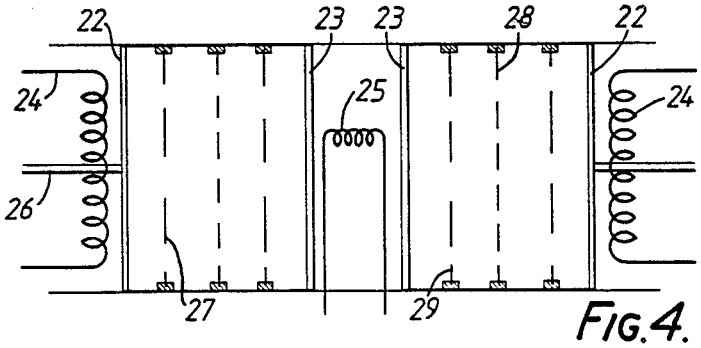

In an alternative embodiment shown in FIG. 4, a double-ended thyratron has two co-axially arranged cathodes 22 and 23, and associated cathode heaters 24 and 25 respectively. An annulus 26 is located on the outer cathode 22 to provide an electrical lead thereto. Cylindrical control grids 27, 28 and 29 are located between the two cathodes 22 and 23. The thyratron is such that it is able to conduct equally well in both an outwards radial direction and an inwards radial direction.

Figure 5:
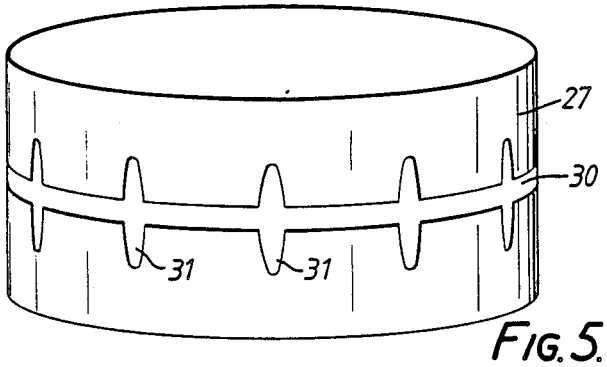
FIG. 5 illustrates part of the thyratron of FIG. 4.

One of the control grids 27 is shown in greater detail in FIG. 5. It has a slot 30 therethrough which extends circumferentially around the centre of the grid 27 and includes axially extensive portions 31, thus providing a single aperture having a large area.

Figure 6:
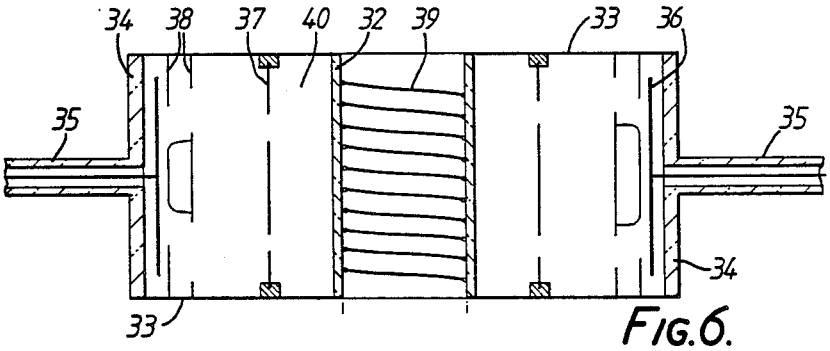

In another thyratron, illustrated in FIG. 6, an annular tube which forms its envelope comprises an inner ceramic cylinder 32, metal end pieces 33, and an outer ceramic cylindrical wall 34, which extends outwards as ceramic discs 35 which surround a metal annulus which is a lead for an anode 36 located within the envelope. The anode 36 is circularly cylindrical and co-axially surrounds a cylindrical electrode 37 at cathode potential. A screen grid 38 is included adjacent the anode 36.

A slow wave structure, which in this embodiment is in the form of a helix 39, is located within the central aperture of the tubular envelope.

Figure 6A:
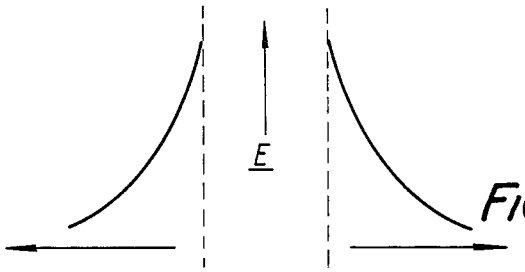
FIGS. 6*a* and 7*a* are explanatory diagrams relating to the operation of the thyratron of FIGS. 6 and 7.

When it is desired to trigger the thyratron of FIG. 6, microwave energy is passed along the helix 39. This produces an electric field parallel to the axis of the helix, the radial distribution of which within the tube is shown in FIG. 6*a*, which causes plasma to be principally produced in the volume defined by the inner tube 32, the cathode 37 and that part of the end pieces 33 between them. The plasma and the walls containing it act together to form a cathode structure. In this embodiment, it is arranged that sufficient plasma is produced within the volume 40 that breakdown occurs and a discharge is produced between the anode 36 and the cathode structure to put the thyratron into its conducting state.

Figure 7:
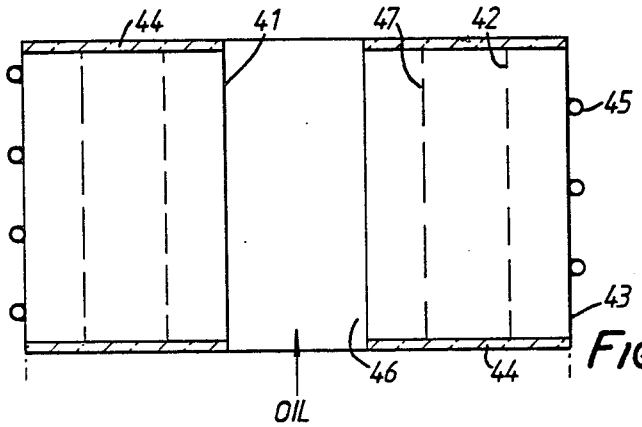
Figure 7A:
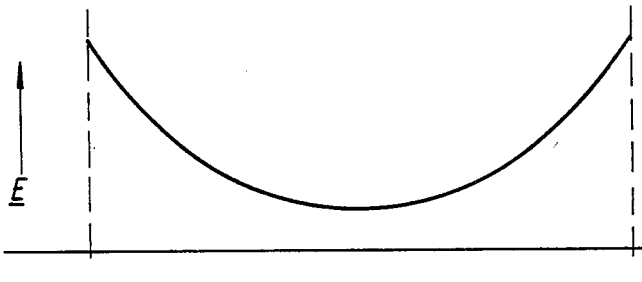

With reference to FIG. 7, another thyratron in accordance with the invention includes a cylindrical anode 41 surrounded coaxially by first electrode 42. The envelope is annular and comprises the anode 41, an outer cylindrical wall 43 and end parts 44. A helix 45 is wound about the outside of the outer wall 43. During operation of the thyratron, a coolant, in this case oil, is arranged to flow through the central aperture 46 to cool the anode. When it is desired to trigger the thyratron into conduction, high frequency electromagnetic energy is transmitted along the helix 45 to produce a discharge within the region generally bounded by the first electrode 42 and the outer wall 43. The electric field produced by the passage of the electromagnetic energy is illustrated in FIG. 7*a*. The discharge obtained, and the surrounding walls, together act as a cathode and when a suitable trigger pulse is applied to a grid 47 located between the cathode so formed and the anode 41, the thyratron conducts.

Figure 8:
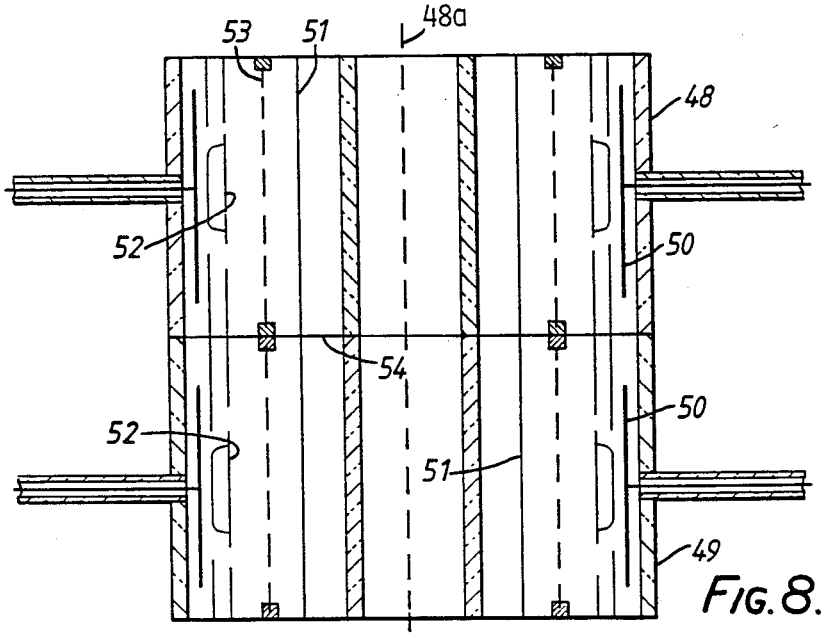

All of the above described embodiments of the invention are constructed such that they may be joined to other arrangements to give a single, large discharge tube. This is illustrated with reference to FIG. 8, in which, in another thyratron in accordance with the invention, two similar arrangements 48 and 49, each capable of acting as a thyratron, are fixed together to form a larger tube. Each of the arrangements 48 and 49 includes a longitudinal axis 48*a*, a cylindrical anode 50, cathode 51, screen grid 52 and control grid 53 located between them. The anodes 50 of the two arrangements 48 and 49 are connected together externally, and the cathodes 51 via intermediate metallic walls 54 which form end pieces of the arrangements if they are not joined together The available electrode surfaces of this thyratron are thus twice as great as those presented by a single arrangement acting as a thyratron, and the current capacity is correspondingly increased. Although in this embodiment the thyratron is shown to have a central aperture, the envelope could be a cylinder instead of an annular.

Figure 9:
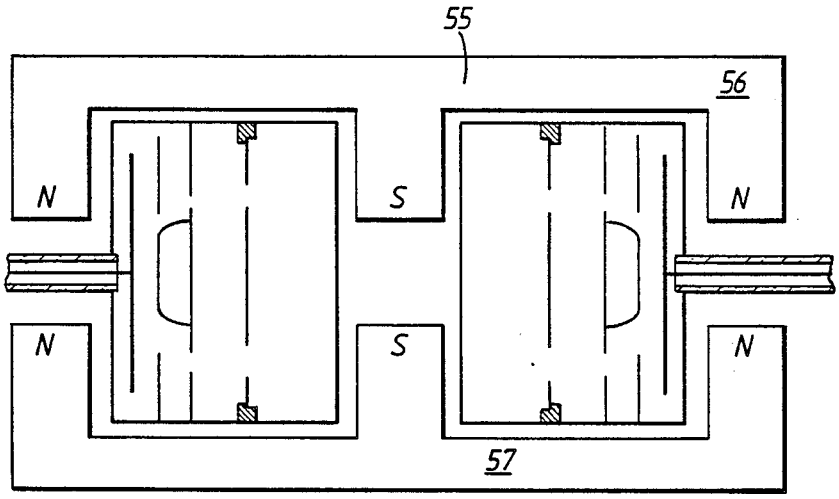

With reference to FIG. 9, another thyratron is similar to that shown in FIG. 2 and also includes a magnetic member 55 having two components 56 and 57. Charged particles produced during conduction are constrained to follow the magnetic field lines, thus giving a uniform discharge.

Other thyratrons in accordance with the invention may be, for example, of the "hollow anode" type, in which plasma is retained at the anode to enable reverse conduction to occur if necessary.

We claim:

1. A discharge tube capable of being coupled to a second discharge tube of substantially the same configuration to provide increased current conducting capability, comprising a cylindrical member having a longitudinal axis;

a first electrode having a first surface area extending along said axis, said first electrode being surrounded by said cylindrical member;

a second electrode having a second surface area extending along said axis, said second electrode being interposed between said cylindrical member and said first electrode, said second electrode being coaxial with said first electrode; and first and second end pieces extending substantially transverse to said longitudinal axis, said end pieces being connected to said cylindrical member to form an envelope containing said first and second electrodes, at least one of said end pieces being removable to permit said discharge tube to be joined to at least one other discharge tube, thereby providing a combined discharge tube having electrodes of increased surface area and a current carrying capacity greater than that of either of said first or second discharge tubes.

2. A discharge tube as claimed in claim I, wherein said first electrode is a cathode and said second electrode is an anode.

3. A discharge tube as claimed in claim 2, which further comprises a screen grid having a portion partially surrounding said anode; and a control grid positioned between said cathode and said screen grid, said screen grid being maintained at the same potential as said cathode;

and wherein said envelope is formed partially by the portion of said screen grid surrounding said anode, said cathode and said end pieces, said envelope having an annular transverse section.

4. A discharge tube as claimed in claim 1, wherein said first electrode is an anode and said second electrode is a cathode.

5. A discharge tube as claimed in claim 4, wherein said envelope further comprises a ceramic annular tube having a central aperture surrounded by said anode, and at least one grid positioned between said cathode and said anode.

6. A discharge tube as claimed in claim 5 which further includes a slow wave structure surrounded by said ceramic annular tube.

7. A discharge tube as claimed in claim 1, wherein said first and second electrodes are coaxial cathodes, and wherein a plurality of coaxial control grids are interposed between said first and second electrodes.

8. A discharge tube as claimed in claim 6, wherein at least one of said control grids has a slot therethrough which extends circumferentially therearound and has axially extensive portions extending in the direction of said longitudinal axis.

* * * * *